United States Patent [19]

Hakoda

[11] Patent Number: 4,549,371

[45] Date of Patent: Oct. 29, 1985

[54] DUST COLLECTING APPARATUS FOR SANDER

[75] Inventor: Kouzou Hakoda, Hiroshima, Japan

[73] Assignee: Ryobi Ltd., Hiroshima, Japan

[21] Appl. No.: 618,786

[22] Filed: Jun. 8, 1984

[30] Foreign Application Priority Data

Jun. 27, 1983 [JP] Japan ..... 58-99737[U]

[51] Int. Cl.[4] ..... B24B 23/00; B24B 55/06

[52] U.S. Cl. ..... 51/170 MT; 51/273

[58] Field of Search ..... 51/170 R, 170 MT, 170 T, 51/170 TL, 273, 180

[56] References Cited

U.S. PATENT DOCUMENTS

| | | | |
|---|---|---|---|
| 2,828,587 | 4/1958 | Miller | 51/180 |
| 3,785,092 | 1/1974 | Hutchins | 51/170 MT |
| 3,793,781 | 2/1974 | Hutchins | 51/170 TL |
| 3,815,292 | 6/1974 | Hutchins | 51/170 MT |
| 3,826,045 | 7/1974 | Champayne | 51/170 T |
| 3,862,520 | 1/1975 | Klebe, Jr. et al. | 51/170 MT |
| 4,302,910 | 12/1981 | Tschacher | 51/170 MT |

*Primary Examiner*—Roscoe V. Parker

*Attorney, Agent, or Firm*—Sughrue, Mion, Zinn Macpeak & Seas

[57] ABSTRACT

An apparatus for collecting dust for a sander. The sander has a generally planar sanding platen affixed to the main body of the sander by several flexible support columns. The sanding platen is driven by an eccentric mounted on a shaft from the main body of the sander. That same shaft drives a fan in a chamber in the main body that is in flow communication with passages through the main body, through the flexible support columns, through a portion of the sanding platen to holes in the platen that are coincident with holes in the sandpaper. Dust from the workpiece being sanded passes through the holes into the platen, through the support columns to the fan chamber without exposing bearings, supporting the shaft and the eccentric, to the dust.

10 Claims, 9 Drawing Figures

DUST COLLECTING APPARATUS FOR SANDER

BACKGROUND OF THE INVENTION

1. Field of the Invention

This invention relates to a dust collecting apparatus for removing dust generated by a sander as it removes material from the surface of a workpiece.

2. Description of the Prior Art

Examples of a conventional dust collecting apparatus for removing dust generated by a sander are disclosed in Japanese Utility Model Publication No. 13674/79 and German "Auslegeschrift" No. 1938350.

Conventional dust collectors require special parts in addition to those used in a conventional sander. For example, one type of conventional dust collecting apparatus requires a separate pipe or the like, which serves as a dust passage to lead dust to a fan from a sander unit having perforated sandpaper. In an alternative type of conventional dust collecting apparatus, separate parts divide the machine into interior and exterior portions to form a dust passage to lead dust from the center of the sander unit to the fan. Such types of machines are equipped with a central bearing in the sander unit and thus require special dustproof means for the protection of the bearing.

The additional special parts required for conventional dust collecting apparatus constitute a disadvantage of conventional machines because the structure of such machines becomes complicated. The more complicated structure increases the production cost and also the weight, while decreasing the mechanical reliability and ease of handling of the sander.

SUMMARY OF THE INVENTION

It therefore is the principal object of the present invention to provide a dust collecting apparatus for a sander that utilizes only the components of the sander itself without adding special parts employed solely for the collecting apparatus. This significantly simplifies the structure and decreases manufacturing costs and weight and increases the mechanical reliability and ease of handling of the sander.

This and other objects of the present invention, as embodied and broadly described herein, are accomplished in accordance with the purpose of the invention by a dust collecting apparatus for a sanding machine having a rotary driven shaft within a main body. Fan blades are mounted on the drive shaft and they rotate within a fan chamber inside the main body.

A sanding platen comprised of an upper drive platen and a lower sandpaper engaging layer is driven by an eccentric portion of the shaft. The sanding platen is affixed to the main body of the sander by a plurality of flexible support columns. The dust collecting apparatus comprises a plurality of holes in the sandpaper engaging layer of the sanding platen. Preferably, these holes are coincident with holes in sandpaper affixed thereto. At least one channel in the drive platen is in flow communication with the holes in the aforesaid layer. The flexible support columns have a hollow bore in flow communication with the channels and in flow communication with at least one passage through the main body of the sander to the fan chamber. Discharge means connect the fan chamber with the environment surrounding the main body of the sander.

Thus, dust from the surface being sanded passes through the holes in the sandpaper engaging surface, through the channels in the drive platen, through the flexible support columns, through the passages in the main body by means of the fan in the main body. Thus, an efficient means of removing the dust without additional components is provided. Furthermore, the bearings in the unit are not subjected to the dust.

Other objects and advantages will be apparent from the description of the preferred embodiment.

DESCRIPTION OF THE PREFERRED EMBODIMENT

The invention is disclosed hereinafter by means of a preferred embodiment illustrated in the accompanying drawings.

Figure 1:
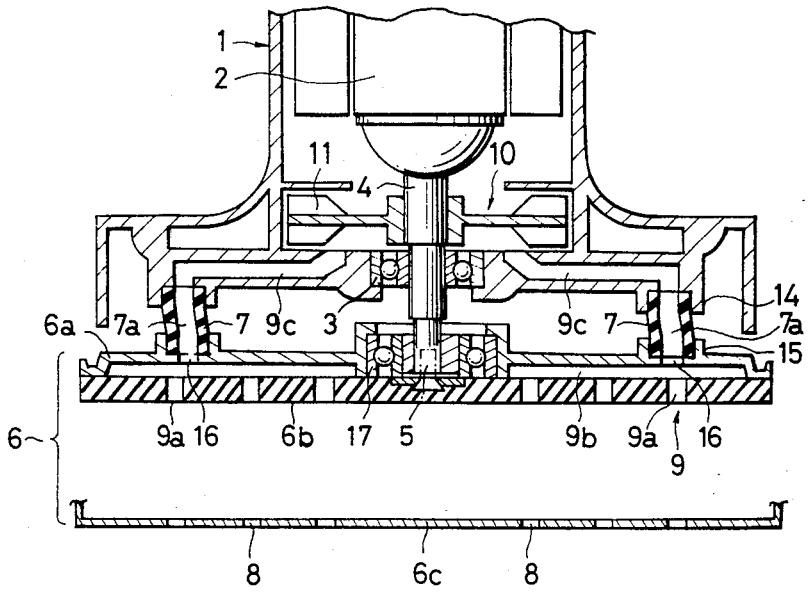
FIG. 1 is a longitudinal partial cross-sectional side view of a sander with a dust collecting apparatus according to the invention.
Figure 2:
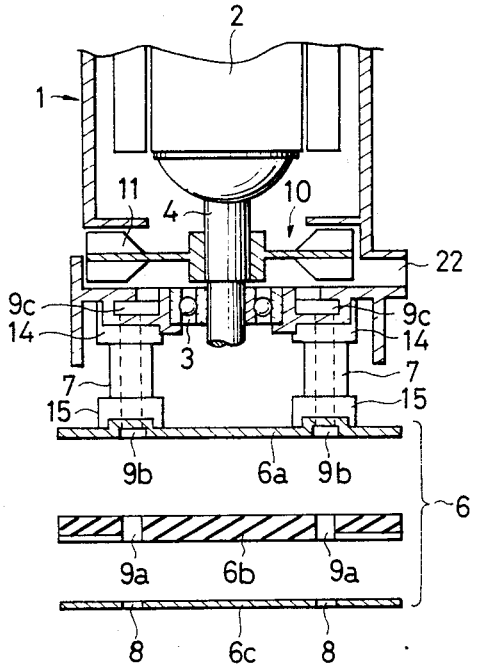
FIG. 2 is a partial cross-sectional plan view of the embodiment of FIG. 1.

As shown in FIGS. 1 and 2, a portion of a hand-held sander incorporates a main body 1 and a drive motor 2. Main body 1 is formed into two sections to facilitate assembly of the components. A portion of a motor shaft 4 of drive motor 2 is supported by a bearing assembly 3. A plurality of fan blades 11 are fixed to a portion of shaft 4 to rotate within a fan chamber 10 as shaft 4 rotates. A sander unit 6 is supported on an eccentric drive shaft 5 that is coupled to motor shaft 4 at the front end thereof. A central portion of shaft 5 is supported by a second bearing assembly 17. Sanding platen 6 is suspended from a number of flexible support columns 7 of soft plastic or the like. Rotation of shaft 5 by the drive motor causes platen 6 to oscillate in a plane that is generally perpendicular to the axis of rotation of shaft 5. A sandpaper sheet **6*c* is mounted on platen 6** for removing material from the surface of a workpiece.

Sanding platen 6 shown in FIGS. 1 and 2 is suspended on the underside of main body 1 by a plurality of flexible support columns 7 and comprises a drive platen **6*a* supported by bearings 17 on eccentric shaft 5, a sandpaper engaging layer 6*b* of sponge rubber or the like is mounted on the underside of drive platen 6*a*, and sandpaper sheet 6*c* is laid on the underside of layer 6*b*. A plurality of holes 8 are provided in sandpaper sheet 6*c*, which is removably mounted on layer 6*b* by a clamp mechanism (not shown) and has upwardly folded opposite edges, as shown in FIG. 1**.

Dust generated as the sander removes material from a workpiece is removed from the sander, the workpiece and vicinity by the dust collecting apparatus of the present invention. The apparatus includes a suction passage in parts of the sanding platen and the main body. A plurality of fan blades mounted on the sander motor shaft in the fan chamber to suck the dust into the fan chamber to be discharged out of the sander.

Figure 3:
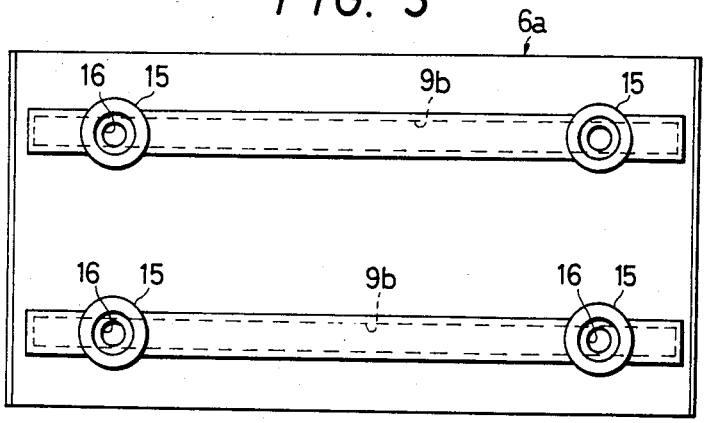
FIG. 3 is a top plan view of a drive platen of the apparatus.

As embodied herein and shown in FIGS. 1, 2 and 3, suction passages 9 include a plurality of holes 9*a* in layer 6*b*, a pair of channels 9*b* formed on the underside of drive platen 6*a* in communication with holes 9*a*, and a pair of passages 9*c* formed in main body 1.

Figure 4A:
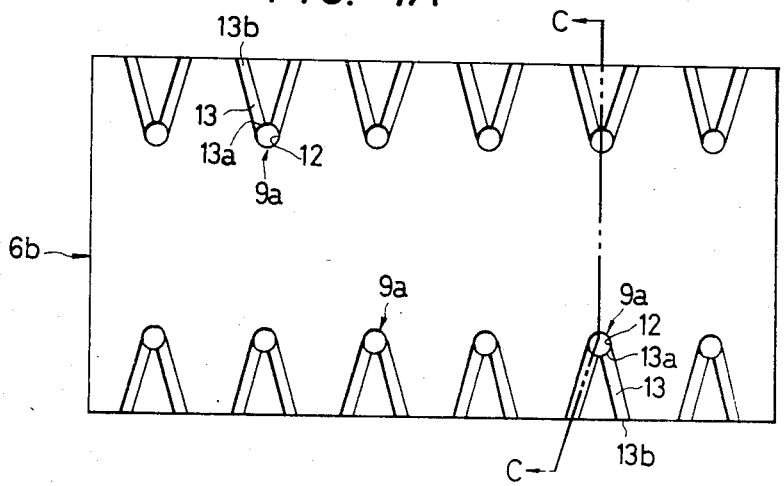
FIG. 4A and 4B are bottom and side views, respectively, of the rubber layer of the sanding platen of FIGS. 1 and 2.
Figure 4C:
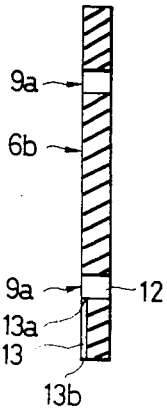
FIG. 4C is a cross-sectional view taken along line C—C of FIG. 4A.
Figure 4B:
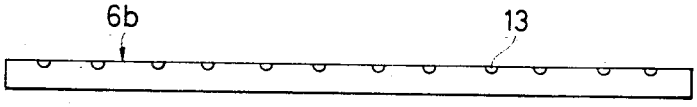

As shown in FIGS. 4A, 4B, and 4C, each of holes 9*a* is formed of a hole 12 bored side-by-side through platen 6*b* to align and communicate with each of holes 8 in sandpaper sheet 6*c*. A pair of grooves 13 is formed on the underside of layer 6*b* to extend between each hole 12 and the edge of layer 6*b*. Each of the grooves 13 on the underside of layer 6*b* terminates on one end in an inner end 13*a* which communicates with hole 12. Each groove 13 terminates on the other edge with an outer end 13*b* that opens to the outer end of layer 6*b*. Grooves 13 in layer 6*b* and sandpaper sheet 6*c*, when mounted on the underside of layer 6*b*, define a passage through which dust can be sucked from the surface of the workpiece, from the peripheral edge region of sandpaper sheet 6*c* and from the vicinity adjacent the sander.

In the embodiment of FIG. 3, each of channels 9*b* formed in drive platen 6*a* is arranged side-by-side to define a passage that aligns with holes 12 and holes 9*a* juxtaposed in layer 6*b*; the underside of layer 6*b* is driven by eccentric drive shaft 5.

In the embodiment of FIGS. 1 and 2, one end of each support column 7 is mounted in a nozzle 14 on the underside of main body 1 and its opposite end to nozzle 15 on the upper surface of drive platen 6*a*. The ends of support columns 7 are airtight and fitted into nozzles 14, 15 and thus are fixed to platen 6*a* and main body 1. One function of support columns 7 is to prevent sanding platen 6 from rotating when motor shaft 4 is rotated while it makes an orbital motion in a plane generally perpendicular to the axis of rotation of the shaft 5. The degree of eccentricity in the planar motion of sanding platen 6 depends on the amount of eccentricity of eccentric shaft 5.

As shown in FIGS. 1 and 2, a bore 7*a* is formed in each support column 7 by having the full length of each of the columns 7 hollow. A plurality of bosses 16, shown in FIGS. 1 and 3, project symmetrically from channels 9*b* and form openings through which channels 9*b* communicate with the interiors of nozzle 15. Thus, the channels 9*b* are in flow communication with passages 9*c* fitted into nozzles 14 and 15.

As depicted in FIGS. 1 and 2, each of the passages 9*c* is arranged side-by-side to define a passage that aligns with bores 7*a* of columns 7, which extend from drive platen 6*a*. Each passage 9*c* is formed in the main body 1 to provide flow communication between fan chamber 10 and bores 7*a*. Each nozzle 14 of main body 1 is formed to communicate with passages 9*c* in main body 1 so that each of the passages 9*c* communicate with a plurality of corresponding bores 7*a* in support columns 7.

As shown in FIG. 2, discharge port 22 communicates between fan chamber 10 and the environment outside of the main body of the sander and may be adapted to be connected to a vacuum (not shown) or a dust collecting bag (not shown).

As set forth hereinbefore, the dust collecting apparatus for the sander according to the invention is designed so that dust, which is generated on the workpiece, is removed by the suction created by fan blades mounted on motor shaft 4 of drive motor 2. The dust travels from holes 8 in sandpaper 6*c* through suction passages 9, bores 7*a* and fan chamber 10 to discharge through port 22 to the environment outside of main body 1. Suction passage 9 is formed so that holes 9*a* in layer 6*b* of the sander unit, channels 9*b* in drive platen 6*a*, and passages 9*c* in main body 1 form parts of a continuous flow path that communicates with discharge port 12. The rest of the continuous flow path leading from holes 8 to discharge port 22 comprises bores 7*a*, which are formed by hollowing support columns 7 and also are in communication with suction passage 9, and fan chamber 10.

Figure 5:
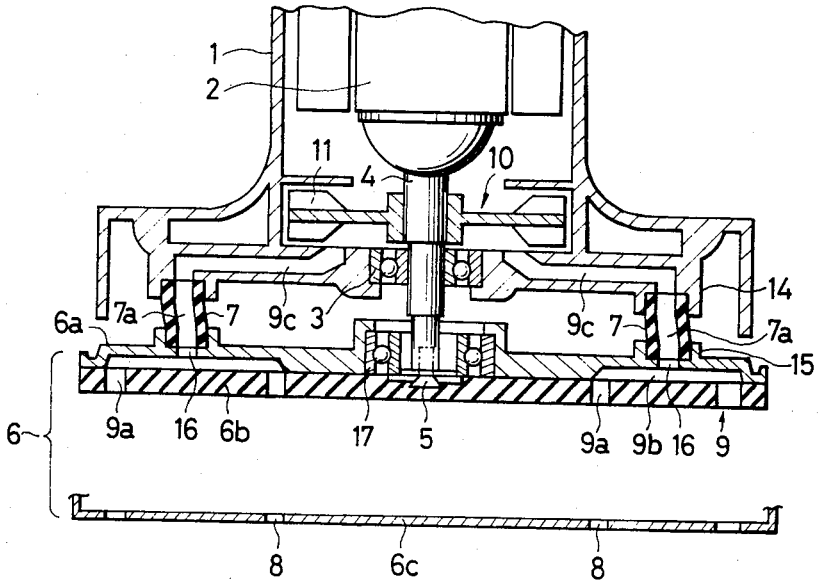
FIG. 5 is a longitudinal partial cross-sectional view of a sander with a dust collecting apparatus according to another embodiment of the present invention.
Figure 7:
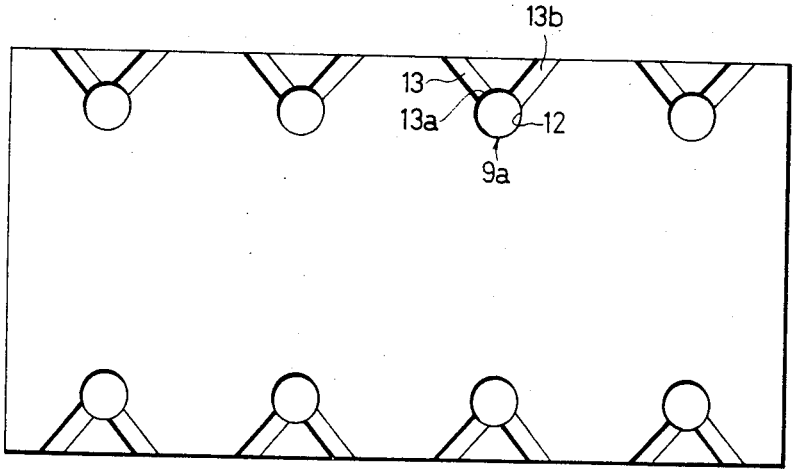
FIG. 7 is a bottom view of the sandpaper engaging layer according to the second embodiment of the invention.
Figure 6:
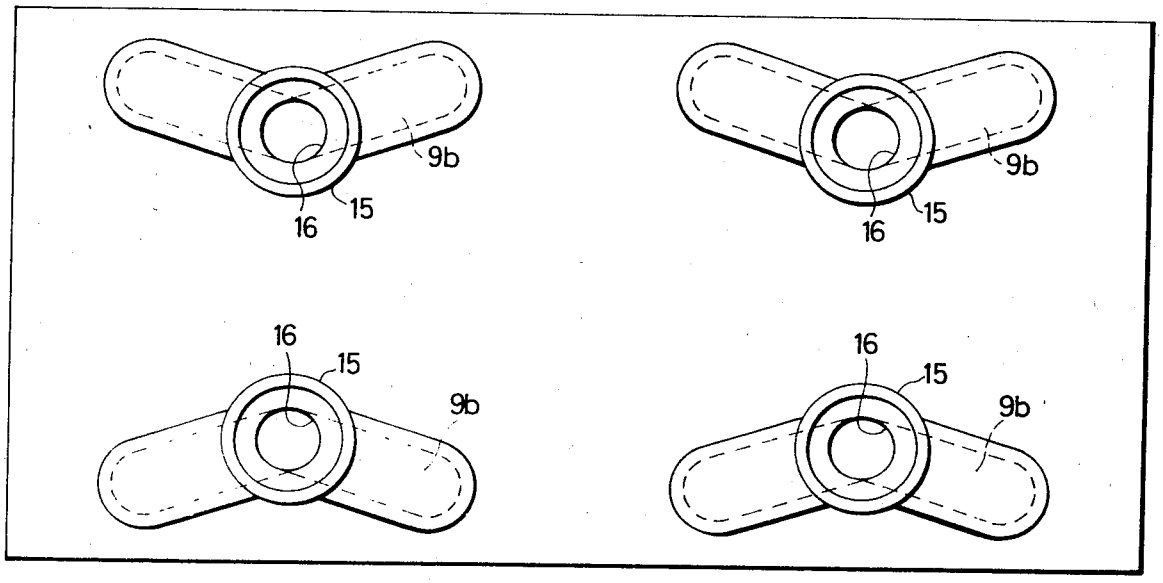
FIG. 6 is a top plan view of a driver platen according to the second embodiment.

A second embodiment of the invention is shown in FIGS. 5–7. According to the second embodiment, all holes 9*a* formed in a sandpaper engaging layer 6*b* are positioned adjacent to inlets of bores 7*a* formed in support columns 7. Therefore, dust sucking performance is further improved. In the second embodiment, holes 9*a* are not formed adjacent to the eccentric drive shaft 5 as opposed to the first embodiment, since sucking force through the holes adjacent to the shaft 5 would be weak.

With this arrangement, the sander and the mechanism constituting the dust collector are composed of the minimum number of components, because special additional parts therefor are not required. Furthermore, dustproof means for the central bearing may be eliminated, thus significantly simplifying the structure. These simplifications in the structure result in a reduction in production cost and weight and improve the operating performance of the sander.

While the invention has been disclosed in terms of a preferred embodiment, the scope of the invention is not limited thereto. The scope of the invention is determined by the appended claims and their equivalents.

What is claimed is:

1. A dust collecting apparatus for a sanding machine having a rotary driven shaft within a main body, fan blades mounted on said shaft disposed to rotate within a fan chamber, a sanding platen comprised of an upper drive platen and a lower sandpaper engaging layer, said sanding platen being driven by an eccentric portion of said shaft, said sanding platen being affixed to said main body by a plurality of flexible support columns, said apparatus comprising:

a plurality of holes in said sandpaper engaging layer;

at least one channel in said drive platen in flow communication with said holes;

a hollow bore through the length of said columns, said bore being in flow communication with said channel;

at least one passage in said main body in flow communication with said bore of said column and said fan chamber; and discharge means in flow communication with said fan chamber and the environment outside said main body.

2. The apparatus of claim 1 wherein said main body includes nozzle means for engaging one end of said flexible support columns.

3. The apparatus of claim 1 wherein said sanding platen includes nozzles for engaging the other end of said flexible support columns.

4. The apparatus of claim 1 wherein said flexible support columns are tubular plastic.

5. The apparatus of claim 1, wherein said sandpaper engaging layer includes a sandpaper engaging surface, said surface including a plurality of grooves leading from said holes in said layer to the edge of said layer.

6. The apparatus of claim 5 wherein said sanding platen is rectangular having two short ends and two longer sides, said grooves leading from said holes to the edge of said sandpaper engaging layer along said sides.

7. The apparatus of claim 6 wherein each of said holes in said layer has two grooves associated therewith, said grooves being disposed in a V-shape with said holes at the apex of said V.

8. The apparatus of claim 5 wherein said apparatus includes a sheet of perforated sandpaper, said perforations being coincident with said holes in said layer, said sandpaper being disposed to cover said grooves to form passages leading from said holes to the edge of said layer.

9. The apparatus of claim 1 wherein said apparatus includes a sheet of perforated sandpaper, said perforations being coincident with said holes in said layer.

10. The apparatus of claim 1, wherein said plurality of holes in said sandpaper engaging layer are formed at positions only adjacent to said hollow holes of said columns.

* * * * *